US008622593B2

(12) United States Patent
Cristoforo

(10) Patent No.: US 8,622,593 B2
(45) Date of Patent: Jan. 7, 2014

(54) RATCHET CLIP

(71) Applicant: Sight Saver, LLC, Stuart, FL (US)

(72) Inventor: Michael Cristoforo, Palm City, FL (US)

(73) Assignee: Sight Saver, LLC, Stuart, FL (US)

( * ) Notice: Subject to any disclaimer, the term of this patent is extended or adjusted under 35 U.S.C. 154(b) by 0 days.

(21) Appl. No.: 13/665,351

(22) Filed: Oct. 31, 2012

(65) Prior Publication Data

US 2013/0114275 A1 May 9, 2013

Related U.S. Application Data

(60) Provisional application No. 61/555,332, filed on Nov. 3, 2011.

(51) Int. Cl.
*F21V 21/00* (2006.01)
*F21V 17/06* (2006.01)

(52) U.S. Cl.
USPC ..... 362/396

(58) Field of Classification Search
None
See application file for complete search history.

(56) References Cited

U.S. PATENT DOCUMENTS

| | | | |
|---|---|---|---|
| 1,294,752 | A | 2/1919 | Ballard |
| 4,244,011 | A | 1/1981 | Hammel et al. |
| 4,506,317 | A | 3/1985 | Duddy |
| 4,541,555 | A | 9/1985 | Miree |
| 4,678,153 | A | 7/1987 | Maddock et al. |
| 4,897,768 | A | 1/1990 | Thul |
| 5,521,803 | A | 5/1996 | Eckert et al. |
| 5,564,817 | A | 10/1996 | Palmer |
| 5,717,267 | A | 2/1998 | Paroz |
| 6,012,827 | A | 1/2000 | Caplan et al. |
| 6,190,020 | B1 | 2/2001 | Hartley |
| 6,280,050 | B1 | 8/2001 | Bird et al. |
| 6,616,294 | B1 | 9/2003 | Henry |
| 6,718,136 | B2 | 4/2004 | Bird et al. |
| 6,764,194 | B1 | 7/2004 | Cooper |
| 6,874,908 | B2 | 4/2005 | Sharrah et al. |
| 7,311,418 | B2 | 12/2007 | Zeller et al. |
| 7,390,105 | B2 | 6/2008 | Nelson et al. |
| 7,422,356 | B2 | 9/2008 | Hama et al. |
| 7,481,554 | B2 | 1/2009 | Anderson et al. |
| 7,510,295 | B2 | 3/2009 | Shih |
| D591,439 | S | 4/2009 | Cristoforo |
| D599,046 | S | 8/2009 | Cristoforo |
| D602,620 | S | 10/2009 | Cristoforo |
| 7,618,152 | B2 | 11/2009 | Tsung |
| D609,376 | S | 2/2010 | Cristoforo |

(Continued)

FOREIGN PATENT DOCUMENTS

| | | |
|---|---|---|
| CA | 2091106 | 3/1993 |
| DE | 202007001258 | 1/2007 |
| WO | WO2009137470 | 11/2009 |
| WO | WO2011034773 | 3/2011 |

*Primary Examiner* — Natalie Walford
(74) *Attorney, Agent, or Firm* — McHale & Slavin, P.A.

(57) ABSTRACT

This invention relates generally to an illumination system that is configured for attachment to a hard hat or the temple arm portion of a pair of eyeglasses. The illumination system includes a light source and a multi-axis pivot assembly to permit directional adjustment and focus of a beam of light. An adapter clip is provided to facilitate attachment to the temple arm portion of the eyeglasses. The adapter clip includes a plurality of grooves positioned between two flexible side portions to allow the clip to be slid along the temple arm to a desired position and snapped into a locked position. The illumination system is fully adjustable in terms of light intensity and direction of the light beams.

15 Claims, 13 Drawing Sheets

(56) References Cited

U.S. PATENT DOCUMENTS

| | | | |
|---|---|---|---|
| D619,285 | S | 7/2010 | Cristoforo |
| D649,668 | S | 11/2011 | Cristoforo |
| 2002/0080608 | A1 | 6/2002 | Wienhold |
| 2003/0067771 | A1 | 4/2003 | Kung |
| 2004/0141317 | A1 | 7/2004 | Sun |
| 2005/0018420 | A1 | 1/2005 | Parsons |
| 2005/0248932 | A1 | 11/2005 | Waters |
| 2006/0061991 | A1 | 3/2006 | Yeh |
| 2006/0120066 | A1 | 6/2006 | Huang |
| 2007/0030672 | A1 | 2/2007 | Offiler et al. |
| 2007/0177375 | A1 | 8/2007 | Petzl |
| 2009/0059607 | A1 | 3/2009 | Yoon |
| 2009/0116230 | A1 | 5/2009 | Young |
| 2010/0053944 | A1 | 3/2010 | Yao-Lin |
| 2010/0103653 | A1 | 4/2010 | Liu |
| 2010/0103656 | A1 | 4/2010 | Cho |
| 2011/0063827 | A1 | 3/2011 | Cristoforo |

RATCHET CLIP

REFERENCE TO RELATED APPLICATIONS

In accordance with 37 C.F.R 1.76, a claim of priority is included in an Application Data Sheet filed concurrently herewith. Accordingly, the present invention claims the benefit of the filing date and/or priority under 35 U.S.C. 119(e), 120, 121, and/or 365(c) to U.S. Provisional Patent Application No. 61/555,332, filed Nov. 3, 2011, entitled, "Ratchet Clip". This application is also related to following applications: U.S. patent application Ser. No. 13/166,401, filed Jun. 22, 2011, entitled "Attachable Illumination System"; which claims priority of U.S. Provisional Patent Application No. 61/357,791, filed Jun. 23, 2010; entitled, "Attachable Illumination System"; U.S. patent application Ser. No. 12/878,713, filed Sep. 9, 2010, entitled "Light System"; which claims priority of U.S. Provisional Patent Application No. 61/242,839, filed Sep. 16, 2009, entitled, "Light System", and U.S. Provisional Patent Application No. 61/357,791, filed Jun. 23, 2010, entitled, "Attachable Illumination System"; U.S. patent application Ser. No. 29/338,460, filed Jun. 11, 2009, entitled "Ear Hook with Adjustable Boom Mounted Light"; now issued U.S. Pat. No. D649,668, which is a continuation-in-part of U.S. patent application Ser. No. 29/329,542, filed Dec. 17, 2008, entitled, "Ear Hook with Adjustable Boom Mounted Light", which is now issued U.S. Pat. No. D599,046; U.S. patent application Ser. No. 29/338,461, filed Jun. 11, 2009, entitled, "Eye Glass Clip With Adjustable Boom Mounted Light", now issued U.S. Pat. No. D619,285, which is a continuation-in-part of U.S. patent application Ser. No. 29/329,544, filed Dec. 17, 2008, entitled "Eye Glass Clip with Adjustable Boom Mounted Light"; now U.S. Pat. No. D602,620; U.S. patent application Ser. No. 29/323,470, filed Aug. 26, 2008, entitled "Ear Hook With Removable Light", now issued U.S. Pat. No. D591,439; and U.S. patent application Ser. No. 29/321,822, filed Jul. 24, 2008, entitled "Clip-On Light", now issued U.S. Pat. No. D609,376.

FIELD OF THE INVENTION

The present invention relates to an illumination system, and more particularly to an illumination system adapted for attachment to various thin or small diameter structures. The illumination system includes a light source, a power source, a power switch configured to connect the light source to the power source, and a multi-axis pivot assembly which permits the directional adjustment and focus of a beam of light.

BACKGROUND OF THE INVENTION

The need for proper illumination of an item for viewing in a poorly lit area is known, as is the use of lights and other illuminating devices attached to eyewear to create an illuminated surface. In general, assumptions are made regarding focal distances and light intensities when designing these devices. With reading glasses for example, these assumptions are often based on accepted norms such as average distance between the reading material and the eye glasses, and commonly used print or font sizes. The result is a single light source, or multiple light sources that are either formed integral to or otherwise permanently mounted to existing reading glasses that uni-directionally focus the light to a predetermined focal range at a given intensity. Therefore, the current devices are not readily adjustable to either user preferences or reading conditions. In addition, the integral and/or fixed nature of the prior art devices make repairs, such as battery replacement of the lighting device, difficult or impossible.

There are many variables that non-adjustable reading lights do not account for, yet are necessary for creating a comfortable reading environment for the eyes. For example, a person's age or optical health determines how well one's optic nerve receives light, and thus one's comfortable focal distance under variable lighting conditions. The type, color, and quality of the paper the reading material is printed on also affects the amount of light required. Newspapers and most books use a soft, off-white paper that absorbs light and minimizes glare. Magazines, on the other hand, are often printed on high gloss white paper that requires a lower intensity, diffused light source for maximum eye comfort. The amount and directional location of any ambient light also needs to be considered and adjusted for. The inability to adjust to these and other variables may result in increasing the potential for eye strain or eye fatigue rather than minimizing it.

This application uses LED's as the light source. LED's are low power light sources that offer a high lumen light emission. Prior art LED lighting devices are typically built into eyeglass frames. One disadvantage to this type of construction is that the power source(s), wiring, switches, etc., must also be built into the frames. This construction requires the glasses to be significantly redesigned to incorporate the light assemblies. Many of the changes required to incorporate the hardware make the designs unpopular for fashion and add significant weight to the assembly. The changes in style and weight are required whether or not the owner of the glasses utilizes the light source.

Additionally, these same constraints and variables may be applied in areas other than recreational reading as well. For example, many jobs require workers to perform their duties in poorly lit work environments in an area where it is impractical to bring in an external light source. Various examples of this would be an electrician that may be working during an electrical outage, a coal miner, a construction worker, an auto mechanic, etc. Many of these workers are required to wear hard hats for safety reasons. Therefore, many hard hats are provided with a rectangular opening into which a mount is rigidly attached for a portable light. The mount includes a circular aperture having a thumb screw through which a flashlight is slid through the aperture and the thumb screw tightened against its side. This device includes several drawbacks. For example, the light extends away from the helmet making it susceptible to being caught in wiring, tree limbs, structures and the like. Because the light bracket is rigidly attached to the hard hat, this may create a dangerous situation. In addition, the rigid attachment and thumbscrews prevent quick removal of the light for hand held usage. Still yet, the rigidly fixed mount does not provide the angular adjustment necessary for some lighting requirements.

Light systems are used in areas where low light can inhibit human activities including such things as repairs, observations, reading and the like. When properly directed, little light is actually needed for such activities. Large lights, such as ceiling lights, often result in shadows being cast on areas of interest since the person is often positioned between the area of interest and the light source. Also, some such lights are designed to light large areas and cannot be directed without affecting illumination in some areas meant to be illuminated.

Some solutions to directed lighting include such things as so-called work lights on articulated arms that may be positioned adjacent an area of interest. These lights tend to be large and require adjustment if the user moves and needs to redirect the light; requiring use of one or more hands to effect the light redirection, hands that may be busy doing other jobs.

Such lights may also be found in combination with magnifiers and are referred to as magnifier lights. Headlamps are also provided, and through the use of straps and/or a helmet, can be mounted on a user's head and can be redirected by moving the head although with limits. Such lights can be provided with a pivot to assist in the redirection.

Such lights, while being somewhat effective, have limits, particularly in the ability to redirect over a large range of adjustment, and sometimes being fixed in place or requiring hands to redirect.

Accordingly, there is a need for an attachable illumination system that is constructed and arranged for attachment to eyewear, hard hats and the like to provide illumination in poorly lit areas. More particularly, there is a need for an attachable illumination system where the light source is fully adjustable in terms of light intensity and direction of the light beams produced by the illumination system. Furthermore, it would be desirable if the attachable illumination system incorporated a light source and power source for efficiency packaged in a non-intrusive, comfortable and aesthetically pleasing manner. The light source should be removable and replaceable with respect to the mount, and should be adapted to be secured to various structures with a single adapter clip without modification.

SUMMARY OF THE INVENTION

The present invention relates generally to an illumination system and, more particularly, to an attachable illumination system that is configured for attachment to relatively thin structures such as the frame portion of a pair of eyeglasses/eyewear or the edge of a hard hat. The attachable illumination system includes a light source, a power source, a power switch configured to connect the light source to the power source, and a multi-axis pivot assembly to permit directional adjustment and focus of a beam of light. An adapter clip is provided to facilitate attachment to the thin structure. One such adapter clip includes a tapered lead-in and at least one barb positioned between two flexible side portions to allow the clip to be slid over a surface to a desired position so that the barb engages opposite side portion of the clip or the material within the clip to maintain a locked position. Another adapter clip includes a plurality of grooves positioned between two flexible side portions to allow the clip to be slid along the temple arm of a pair of glasses to a desired position and snapped into a locked position. The illumination system is fully adjustable in terms of light intensity and direction of the light beams. Furthermore, the invention may provide a means to fully adjust the focus of the light beams from a narrow point of light to a relatively broad beam of light. This addresses the problem of eye strain caused by poor lighting by allowing the user to adjust the light beams to cover the precise area desired of the item being viewed. Additionally, the invention may provide a means to adjust the intensity of the light projected onto the item being viewed. This addresses the problem of eye fatigue caused by improper lighting by allowing the user to adjust how brightly an item is illuminated, thus preventing the need to stare at an item that is too dark, or the glare off an item that is too brightly illuminated. Furthermore, the invention may provide a means to adjust the directional focus of the light to the item being viewed. This addresses the problems of using an assumed focus distance which is fixed by allowing the user to adjust the direction of the light output so as to focus on an item at a distance that provides maximum eye comfort to the user. The attachable illumination system can be scaled to a variety of sizes.

The present invention preferably utilizes LED's as the light source that emit white light, such as the LUXEON™ series LED's manufactured by LUMILEDS™. These LED's have a high flux output, 100,000 hour lifespan, operate on a low direct current (DC) voltage input signal, are fully dimmable, and operate at cool temperatures, making them ideal for attachment onto surfaces that are maintained in close proximity to the user's face. Of course, those skilled in the art will understand that various types of high intensity LED's are available in the industry, and that the invention is not limited to any particular configuration or design of a particular LED. The light source is preferably a self-contained removable and replaceable light assembly, such as a portable flashlight, that is constructed and arranged to snap into a mounting assembly. The light assembly includes a power switch, preferably incorporated into the bezel and configured to connect the light source to a battery power source. The light output from the light source may be adjustable in various intensity levels and focus upon rotation of the bezel. Rotation of the bezel preferably moves a parabolic reflector with respect to the LED light source to change the focus of the emitted light. A lens may be positioned at or about the distal end of the light assembly which may include curvatures and/or coloration to provide additional light characteristics and modifications as is known in the art. The light source preferably includes a battery, capacitor, bat-cap or other electrical storage means for storing a supply of electrical power for consumption by the LED(s). The electrical storage device is generally positioned within a cylindrical or other shaped tubular portion that is sized to cooperate in a removable and replaceable manner with the mounting assembly.

The mounting assembly includes an adapter clip and an offset arm. The adapter clip is constructed and arranged for securing the mounting assembly to a relatively thin structure or small diameter structure and includes the first portion of the first rotation assembly. The offset arm is generally L-shaped and includes the second portion of the first rotation assembly at a first end and the first portion of a second rotation assembly at a second end thereof. The first and second portions of the first rotation assembly snap together and preferably allow up to 360 degrees of rotational freedom about a first axis of rotation. The first portion of the second rotation assembly is formed onto the friction tube, and like the first rotation assembly, snaps together with the second portion of the second rotation assembly to allow up to 360 degrees of rotational freedom about a second axis of rotation. Each first portion of a rotation assembly includes a snap ring portion and a bearing race portion, while each second portion of a rotation assembly preferably includes a plurality of spring clips and a bearing portion. This combination allows the snap together assembly yet provides thrust and rotational bearings to accept loads and provide controlled rotation, while the spring clips maintain the assembly and provide a predetermined resistance to rotation. This allows the light to be positioned by the user so that the desired position is maintained during movement of the user.

Accordingly, it is an objective of the present invention to provide an illumination system that can be secured to a relatively small or thin structure.

It is a further objective of the present invention to provide an illumination system for eyewear having multiple axes of movement for the light assembly permitting a wide range of adjustment and directing of the light source with respect to the eyewear.

It is yet another objective of the present invention to provide a clip adapter for securing an illumination system to the temple arm portion of eyewear that can be secured to the temple arms of eyeglasses which have various sizes and shapes.

It is a still further objective of the present invention to provide a mounting assembly having two axes of rotation that each provide 360 degrees of rotational freedom.

Still yet another objective of the present invention is to provide an illumination system adapter clip having an open edge for attachment to the edge portion of a thin structure.

A further objective of the present invention is to provide an illumination system mounting assembly that is constructed and arranged for attachment to the edge of a hat.

An even further objective of the present invention is to provide an illumination system mounting assembly that is constructed and arranged to break away upon receiving a predetermined force.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 2:
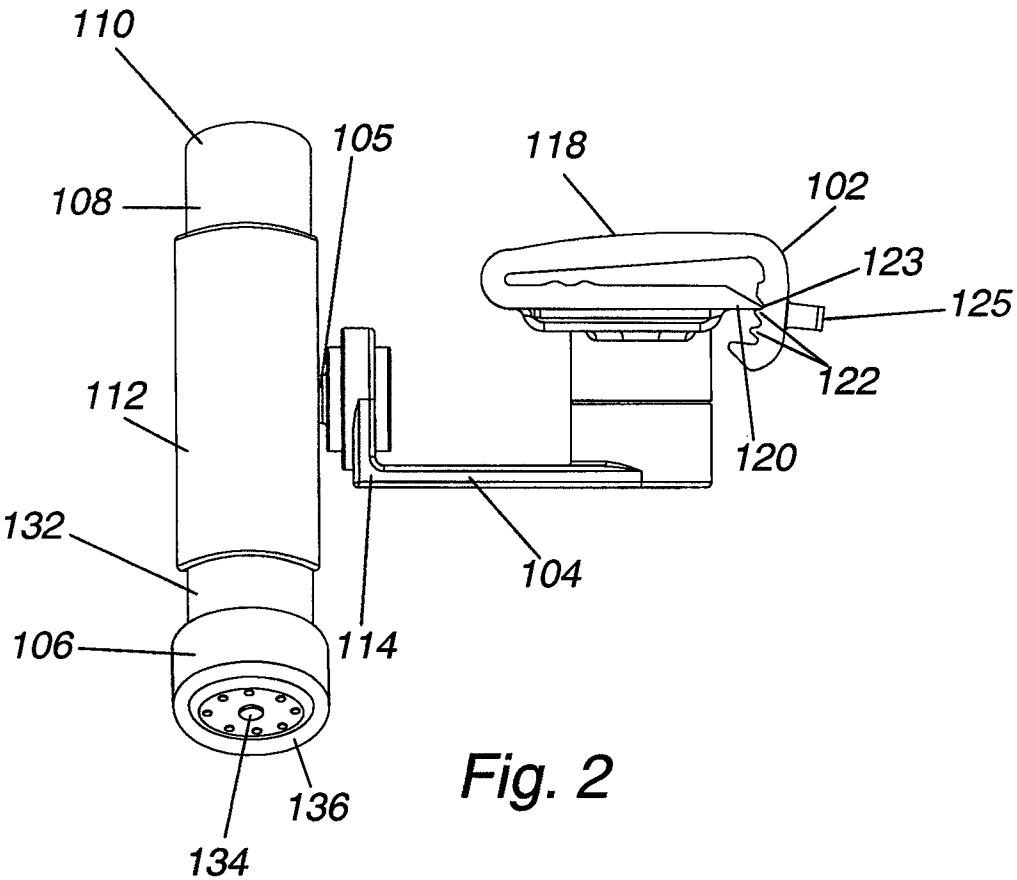
FIG. 2 is an end view of the first embodiment including a light source.
Figure 1:
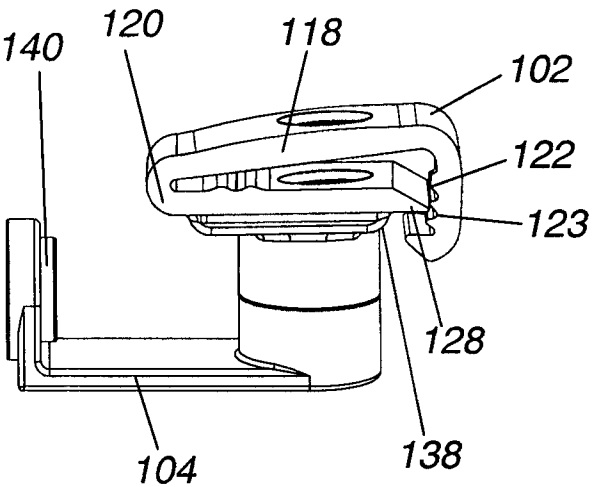
FIG. 1 is an end view of a first embodiment of the present invention including a clip to secure an illumination system to eyewear.
Figure 4:
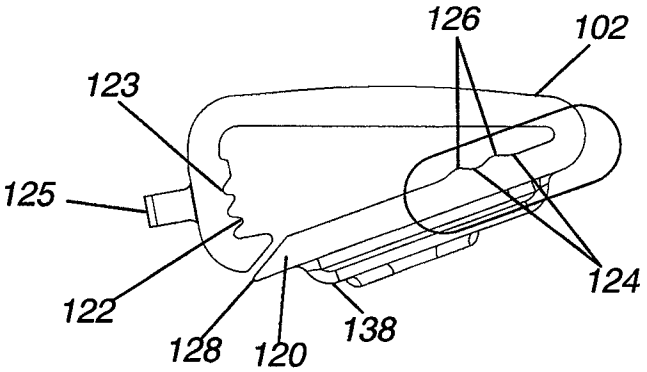
FIG. 4 is an end view of the clip of the first embodiment of the present invention.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 12:
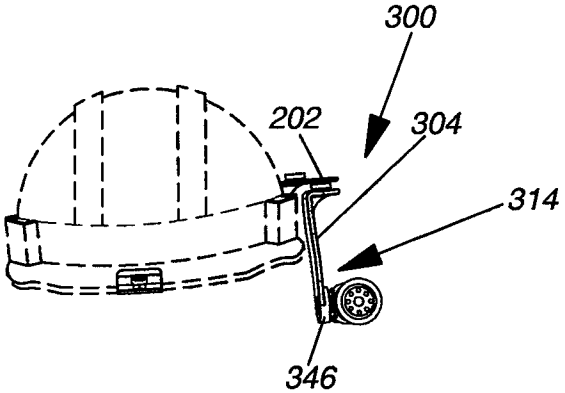
FIG. 12 is a view of another embodiment of the present invention.
Figure 13:
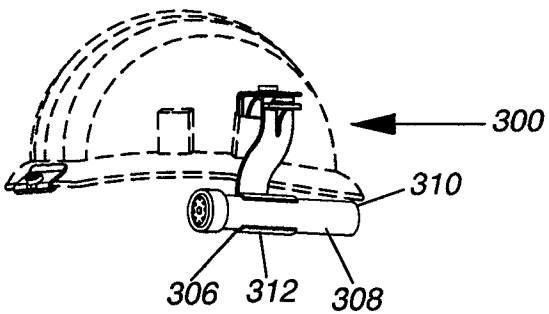
FIG. 13 is another view of the embodiment of the present invention illustrated in FIG. 12.
Figure 10:
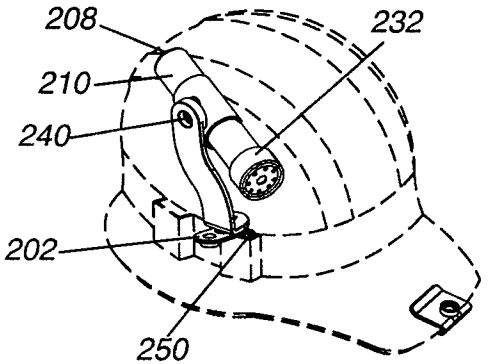
FIG. 10 is a further view of the present invention illustrated in FIG. 7.
Figure 11:
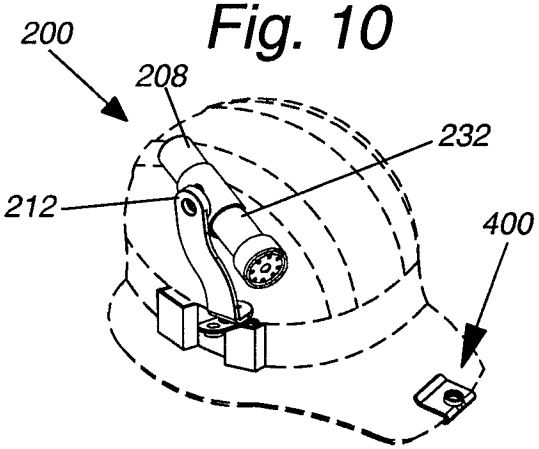
FIG. 11 is a further view of the present invention illustrated in FIG. 7.
Figure 15:
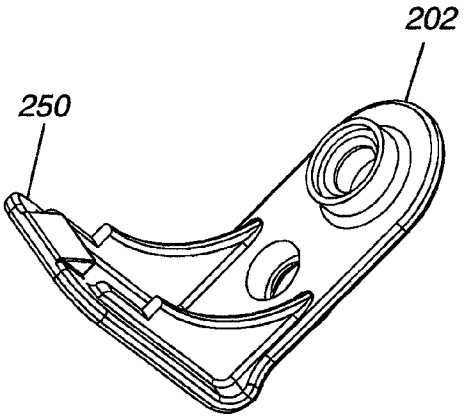
FIG. 15 is a perspective view of an adaptor bracket of the present invention.
Figure 14:
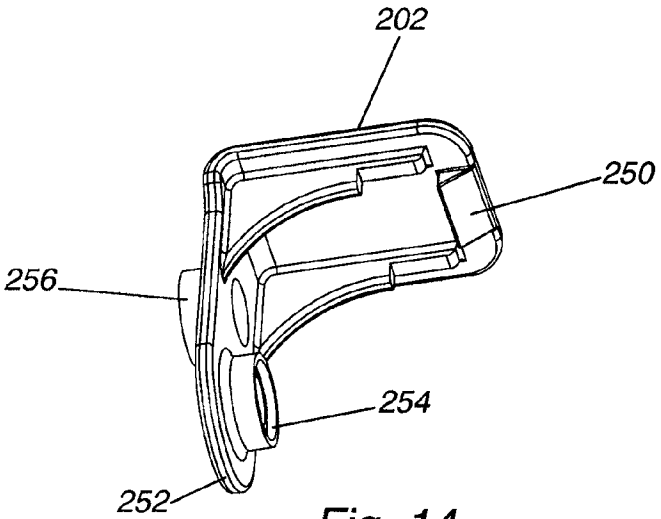
FIG. 14 is a perspective view of an adaptor bracket of the present invention.
Figure 17:
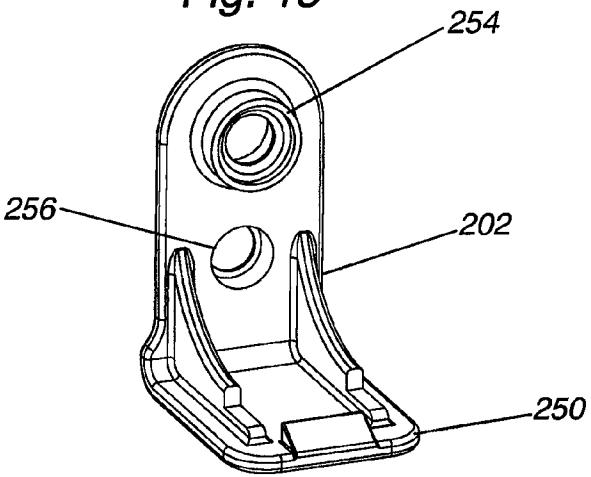
FIG. 17 is a perspective view of an adaptor bracket of the present invention.
Figure 16:
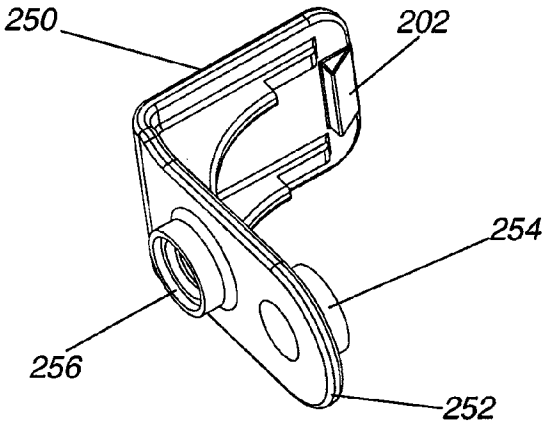
FIG. 16 is a perspective view of an adaptor bracket of the present invention.

FIGS. 1-35, which are now referenced, illustrate illuminations systems 100, 200, 300 and 400, which are different embodiments of the present invention. A first embodiment 100, illustrated in FIGS. 1-6, is constructed and arranged for securement to eyewear. A second embodiment 200, illustrated in FIGS. 7-11, is constructed and arranged for securement to a hard hat. A third embodiment 300, illustrated in FIGS. 12 and 13, is constructed and arranged for securement to a hard hat. A fourth embodiment 400, illustrated in FIGS. 7-11, is constructed and arranged for securement to a hard hat. Each embodiment includes an illumination system which comprise, a light source, a power source, a power switch, and a multi-axis pivot assembly which permits directional adjustment of the light source.

Figure 3:
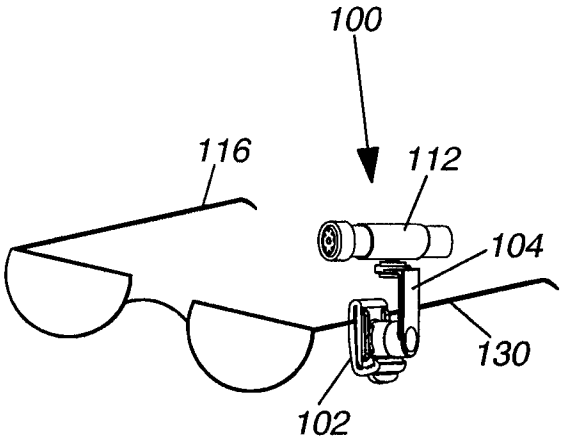
FIG. 3 is a perspective view of the first embodiment secured to eyewear.
Figure 6:
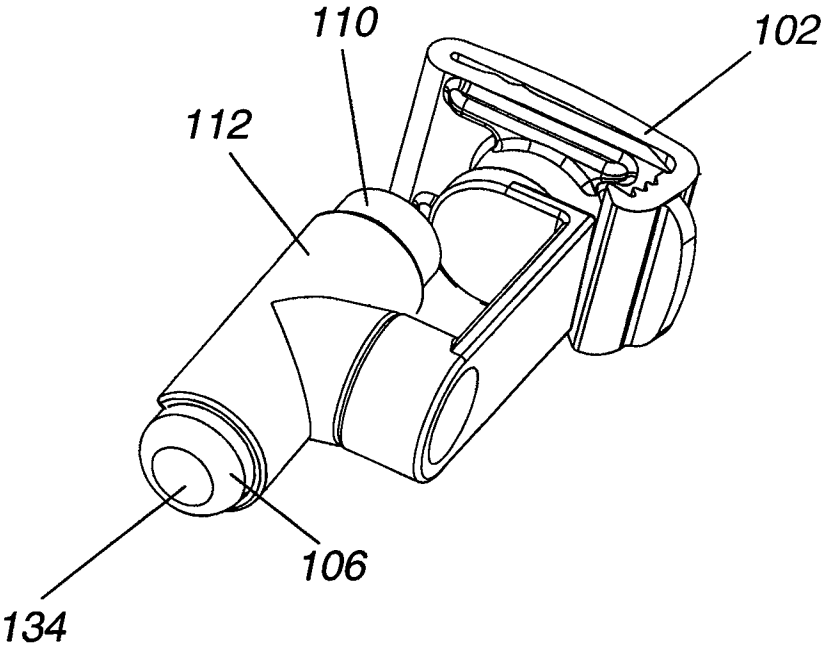
FIG. 6 is a perspective view of the first embodiment of the present invention including a LED light source.
Figure 5:
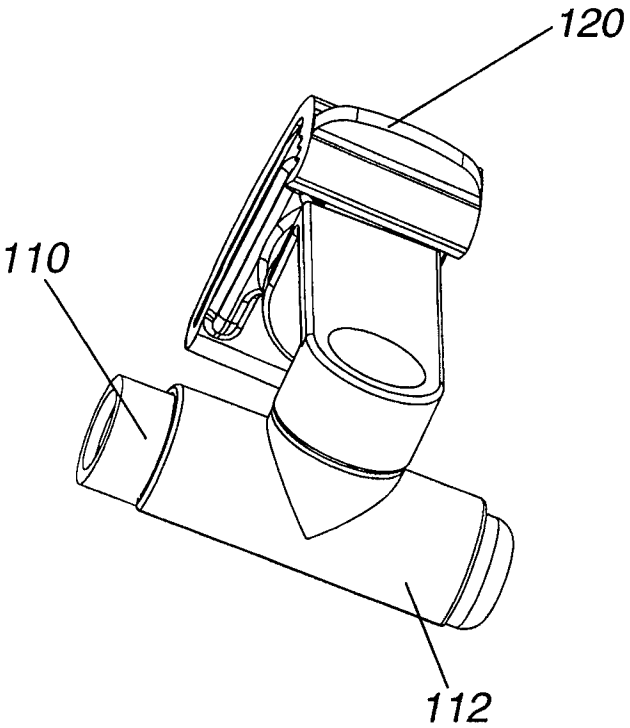
FIG. 5 is a perspective view of the first embodiment of the present invention including a LED light source.
Figure 8:
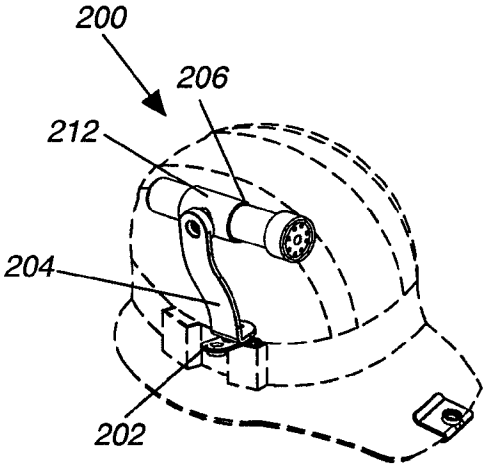
FIG. 8 is a different view of the embodiment of the present invention illustrated in FIG. 7.
Figure 9:
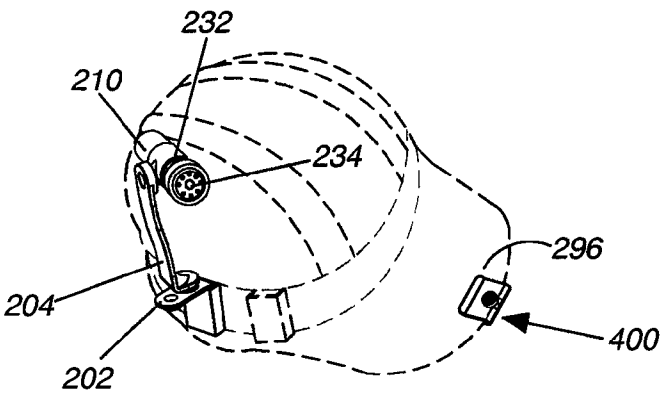
FIG. 9 is a further view of the present invention illustrated in FIG. 7.

The first embodiment of the present invention, 100, includes an adaptor clip 102, an offset arm 104, a power switch 106, a power source 108 (batteries within the light source), a light source 110, and a light source holder 112. The adaptor clip 102, offset arm 104 and light source holder 112 comprise the multi-axis pivot assembly 114. As illustrated in FIG. 3, the first embodiment of the present invention is constructed and arranged to be secured to eyewear 116, such as eyeglasses, safety glasses, sun glasses, etc. The adaptor clip 102 includes a substantially L-shaped portion 118. Hingedly secured to one end of the L-shaped portion 118 is closure member 120. A plurality of teeth or ridges 122 are formed on an inner portion of clip 120. The closure member 120 includes a plurality of grooves 124 located between ridges 126 at one end of the closure member. The opposite end of the closure member includes a tapered end 128. The tapered end 128 passes over ridges 122 of the clip and engages the grooves 123 between the ridges 122. This interaction locks the clip in a closed position. A tab or finger support 125 is located at an end of the adaptor clip 102. This tab 125 provides support for an individual's thumb or finger to grasp when attaching to or removing the clip from glasses.

A temple portion 130 of eyewear 116 is secured in the clip 102 within one of the grooves 124. The different grooves 124 enable adjustment of the illumination system on eyewear. Normally, the clip is secured to the eyewear in one of the grooves 124 and the light assembly is placed on an individual. If adjustment of the offset arm 104 and light source holder 112 do not provide adequate light or light in the proper direction, then the clip is removed from the eyewear and the temple portion of the eyewear is inserted into another groove 123.

The light source 110 preferably comprises a housing 132, one or more batteries (not shown) within the housing, and a light 134 at one end of the light source. The light is preferably an LED, but any other light can be employed. The preferable LED emits a white light, such as the LUXEON™ series LED's manufactured by LUMILEDS™. These LED's have a high flux output, 100,000 hour lifespan, operate on low DC voltage, are fully dimmable, and operate at cool temperatures, which make them ideal for securement to eyewear. Of course, those skilled in the art will understand that various types of high intensity LED's are available in the industry, and that the present invention is not limited to any particular type or configuration of light. The light source preferably also has a lens 136 to focus the light 134. The power switch 106 in the light source is preferably activated by rotating one end of the light source or bezel. Normally, when the one end of the light source is rotated past a certain point, the power from the batteries is connected to the light 134.

The offset arm 104 is pivotally secured to the adaptor clip 102 at bearing 138. The offset arm can pivot through 360 degrees. The offset arm 104 is also preferably L-shaped. One end of the offset arm includes a bearing 140. Bearing 140 enables the light source holder 112 to be pivotally secured to the offset arm 104. The light source holder can pivot through 360 degrees. While the offset arm 104 is preferably L-shaped, it is recognized that other shapes are possible. The offset arm could also be a flexible member which is able to be adjusted in three dimensions.

A second embodiment of the present invention is illustrated as 200 in FIGS. 7-11. This second embodiment includes an adaptor bracket 202, an offset arm 204, a power switch 206, a power source 208 (batteries within the light source), a light source 210, and a light source holder 212. The adaptor bracket 202, offset arm 204 and light source holder 212 comprise the multi-axis pivot assembly 214. The second embodiment of the present invention is constructed and arranged to be secured to a hard hat.

The light source 210 preferably comprises a housing 232, one or more batteries (not shown) with in the housing, a light 234 at one end of the light source. The light is preferably a LED, but any other light can be employed. The preferable LED emits a white light, such as the LUXEON™ series LED's manufactured by LUMILEDS™. These LED's have a high flux output, 100,000 hour lifespan, operate on low DC voltage, are fully dimmable, and operate at cool temperatures, which make them ideal for securement to eyewear. Of course, those skilled in the art will understand that various type of high intensity LED's are available in the industry and that the present invention is not limited to any particular type or configuration of light. The light source preferably also has a lens 236 to focus the light 234. The power switch 206 in the light source is preferably activated by rotating one end of the light source or bezel. Normally, when the one end of the light source is rotated past a certain point, the power from the batteries is connected to the light 234.

Referring now to a portion of the second embodiment, and in particular to FIGS. 14-17 where the adaptor bracket 202 for attaching the present device to a hard hat is illustrated. The adaptor bracket 202 is preferably L-shaped, while those skilled in the art recognize that it could be any other shape, including a flexible member. One portion 250 of the adaptor bracket 202 is constructed and arranged to fit into a slot 261 (FIG. 19) of a hard hat. The slot 261 is preferably on either side of a hard hat. The other portion 252 of the adaptor bracket includes at least two bearing members 254 and 256. The offset arm 204 is pivotally secured to the adaptor bracket 202 at bearing 256. In this configuration, the light source 210 is positioned above an individual's eyes and relatively close to their head. This configuration enables the light from the light source to be aligned with an individual's line of sight. The offset arm can pivot through 360 degrees. The offset arm 204 is also preferably S-shaped. One end of the offset arm includes a bearing 240. Bearing 240 enables the light source holder 212 to be pivotally secured to the offset arm 204. Bearing 240 functions in a manner similar to bearing 105 in FIG. 2. The light source holder can pivot through 360 degrees. While the offset arm 204 is preferably S-shaped, it is recognized that other shapes are possible. The offset arm could also be a flexible member which is able to be adjusted in three dimensions.

An alternative configuration of the second embodiment of the present invention is illustrated as 300 in FIGS. 12 and 13. This alternative configuration includes an adaptor bracket 202, which is the same bracket as the second embodiment of the invention, an offset arm 304, a power switch 306, a power source 308 (batteries within the light source), a light source 310, and a light source holder 312. The adaptor bracket 202, the offset arm 304 and the light source holder 312 comprise the multi-axis pivot assembly 314. The alternative configuration of the second embodiment of the present invention is also constructed and arranged to be secured to a hard hat so that the offset arm extends downward instead of upward with respect to the hard hat.

The adaptor bracket 202, illustrated in FIGS. 14-17 and 30-35, is preferably L-shaped and those skilled in the art recognize that it could be formed to have an included angle of more or less than 90 degrees. A first leg portion 250 of the adaptor bracket 202 is constructed and arranged to fit into a slot 261 of a hard hat. A catch 293 is provided to engage the hard hat to secure the two pieces together. The catch includes a ramp side 294 and a catch side 295. The slot 261 is preferably on either side of a hard hat and is generally rectangular in shape including an undercut or aperture for releasable engagement with the catch member. The second leg portion 252 of the adaptor bracket includes at least two bearing members 254 and 256. The bearing members are positioned on opposite sides of the second leg portion of the adapter bracket 202 to allow the user to insert an offset arm 304 into either side thereof. Whereby the offset arm 304 may be positioned to extend upwardly or downwardly with respect to the hard hat. The offset arm 304 is pivotally secured to the adaptor bracket 202 at bearing 252 for 360 degree rotation. In this configuration, the light source 210 is positioned inline with an individual's eyes and relatively close to the user's head. This configuration enables the light from the light source to be aligned with an individual's line of sight. The offset arm 304 is also preferably S-shaped when viewed from the side thereof and L-shaped when viewed from an end. The S-shape allows the user to move the position of the light forward or backward with respect to the mounting point. A first leg of the offset arm includes a bearing 340. Bearing 340 enables the light source holder 312 to be pivotally secured to the offset arm 304. Bearing 240 functions in a manner similar to bearing 105 in FIG. 2. The first leg of the offset arm includes a length similar to that of the second leg of the adapter bracket to allow the offset arm to pivot through a 360 rotation without interference from the hard hat. The second leg of the offset arm includes sufficient length to allow the light source holder to pivot through 360 degrees of rotation with the light source in place. While the offset arm 304 is preferably S-shaped, it is recognized that other shapes are possible. The offset arm could also be a flexible member which is able to be adjusted in three dimensions.

Figure 33:
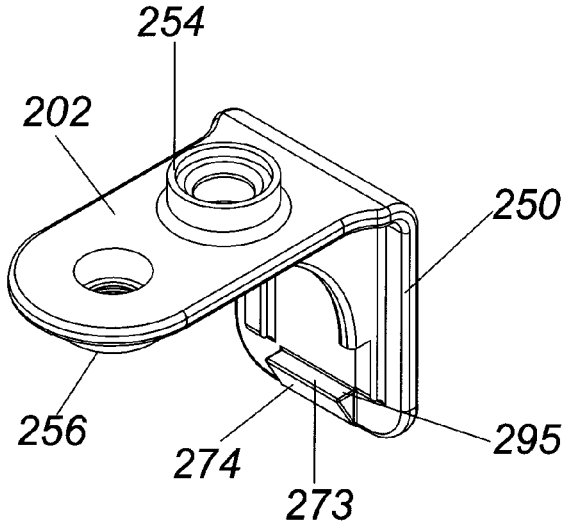
FIG. 33 is a front perspective view of the adaptor bracket in FIG. 30.
Figure 31:
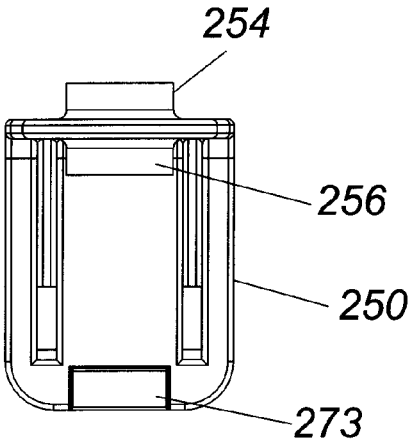
FIG. 31 is a front view of the adaptor bracket in FIG. 30.
Figure 32:
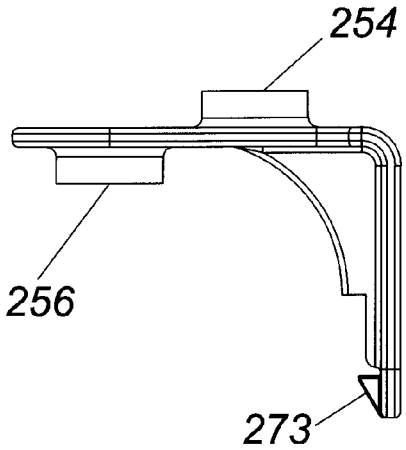
FIG. 32 is a side view of the adaptor bracket in FIG. 30.
Figure 35:
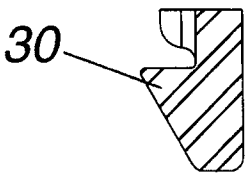
FIG. 35 is a cross-sectional view of the latch along B-B in FIG. 31.
Figure 34:
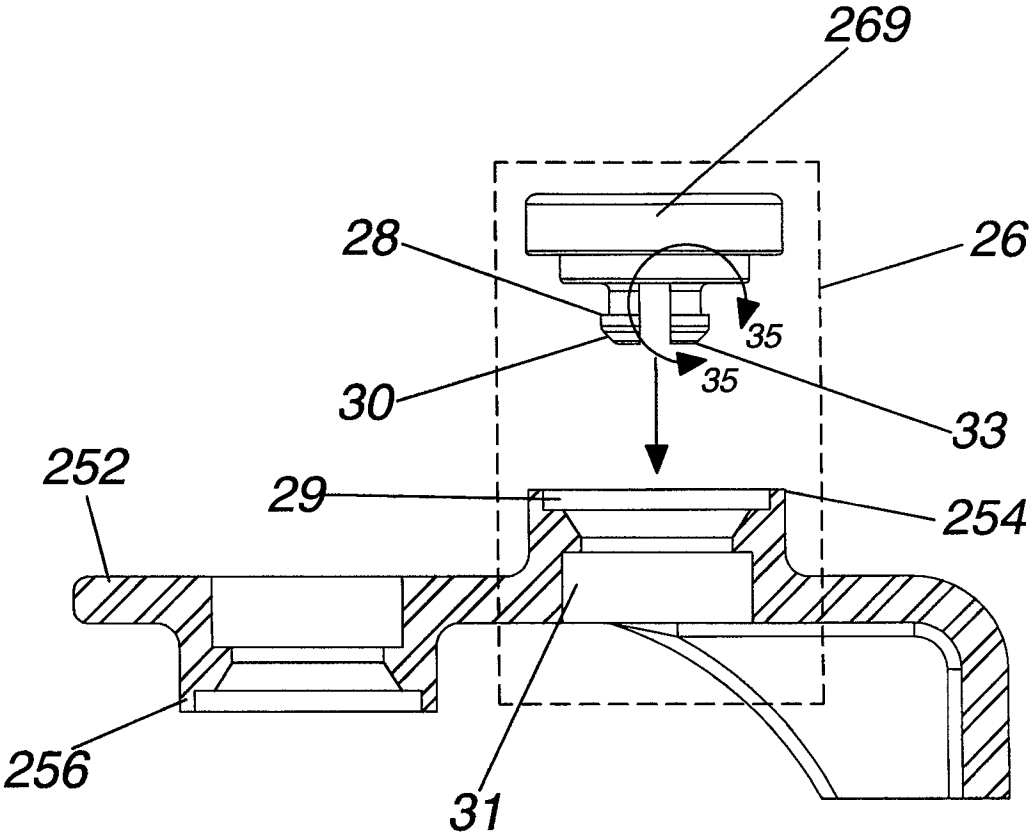
FIG. 34 is a cross-sectional view of the top portion of the adaptor bracket along A-A in FIG. 31.

Referring to FIGS. 33-35, the bearing assembly 26 is provided to connect the offset arm 304 to the adapter bracket 202 and the light mount 18 to the offset arm 202 for rotation about a pivot axes A and B. As shown, the bearing 26 utilizes a post 28 receivable in a socket 29. The post 28 may be in either of the adapter bracket or the offset arm and the socket 29 in the other. In a preferred embodiment, the post 28 can have a flange 30 receivable in an undercut 31 in the socket 29 to provide for a snap lock assembly. Friction between the post 28 and the surface defining the socket 29 can be used to maintain the light mount 18 in a selected pivoted position. The post 28 can be split, having a pair of spaced legs 33. The bearing assembly provides rotation about pivot axes A and B. The pivot axes A, B have different orientations and preferably are generally orthogonal to one another. The axes A, B may also intersect. In a preferred embodiment, the bearing members and subsequent assembly are constructed of resiliently deformable polymeric material to facilitate their assembly with snap lock assembly techniques.

Figure 7:
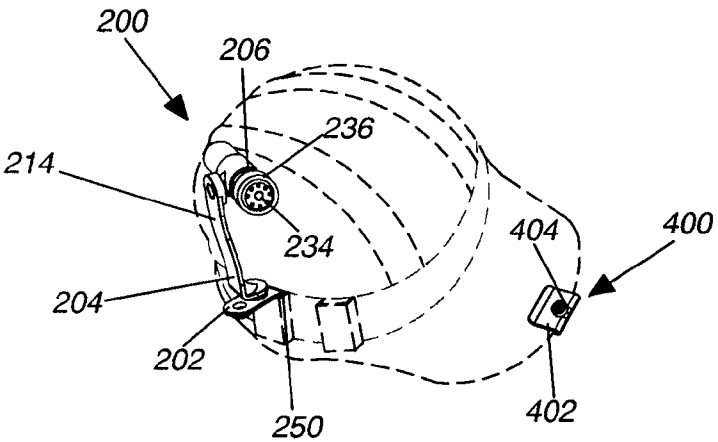
FIG. 7 is a perspective view of another embodiment of the present invention.

A fourth embodiment of the present invention is illustrated as 400 in FIGS. 7-11. In this embodiment an adaptor clip 402 is secured to a front bill of a hard hat. The adaptor clip 402 includes a bearing 404 (FIG. 7). An inner surface of the adapter clip includes teeth (not shown) to engage the surface of the hard hat. An entrance ramp 296 is provided to allow the clip to slide easily onto the bill of the hard hat. An offset arm 204, a power switch, a power source (batteries within the light source), a light source, and a light source holder 274 can be secured to the bearing 404 of the adaptor clip 402 in a manner similar to that of the first embodiment of the present invention. The adaptor clip, offset arm, and light source holder comprise the multi-axis pivot assembly.

Figure 19:
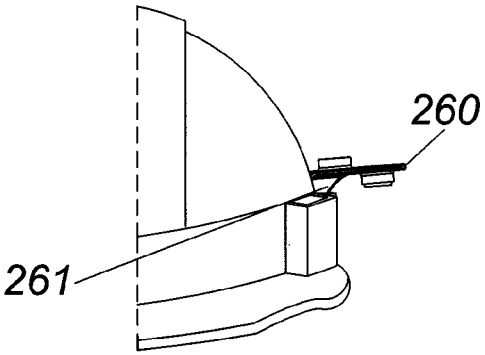
FIG. 19 is a view of the embodiment illustrated in FIG. 18 on a hard hat.
Figure 18:
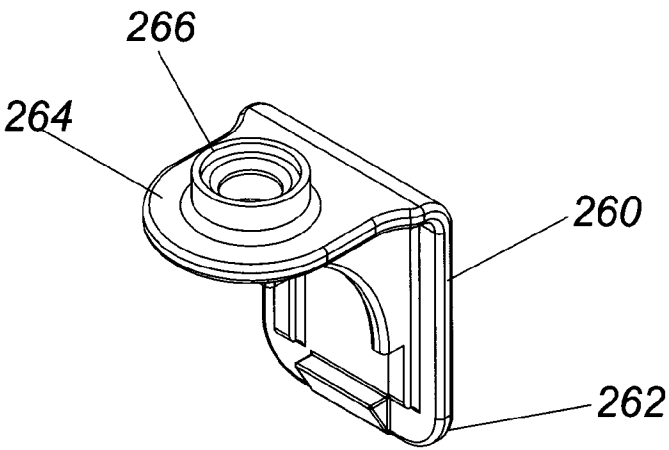
FIG. 18 is a perspective view of another embodiment of an adaptor bracket of the present invention.
Figure 20:
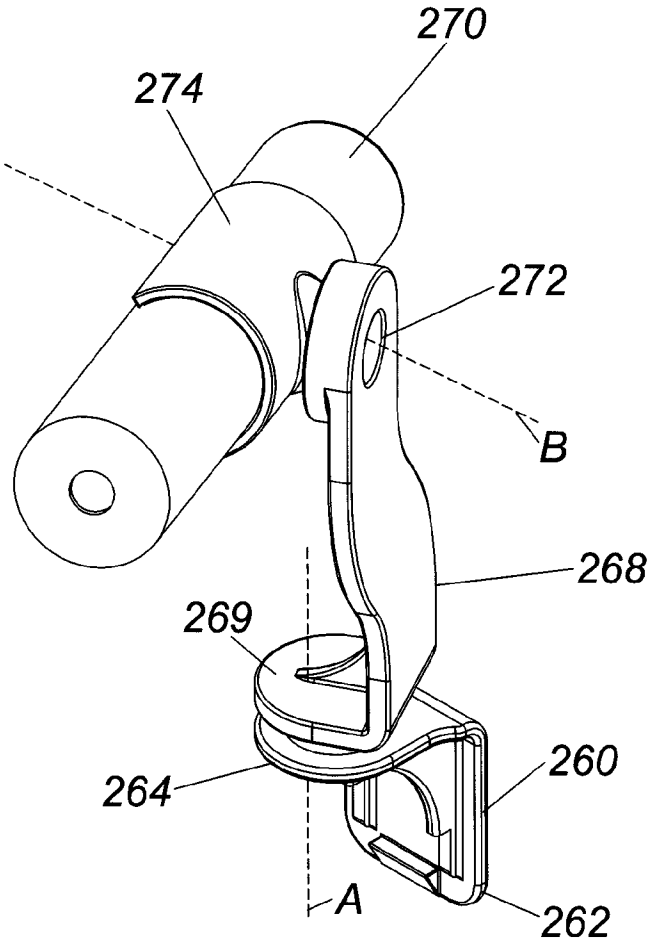
FIG. 20 is a perspective view of the embodiment of FIG. 18 including a light source.
Figure 21:
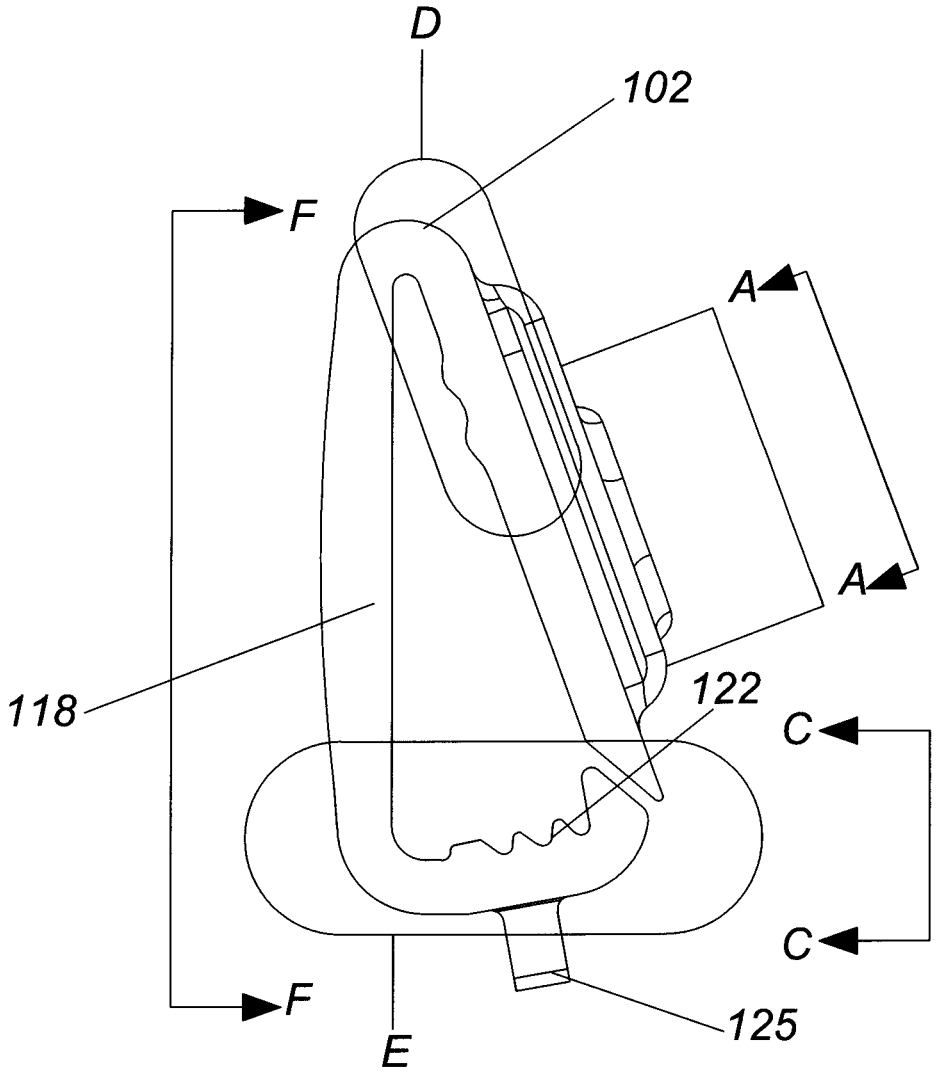
FIG. 21 is a view of the present invention similar to FIG. 4.
Figure 23:
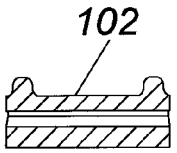
FIG. 23 is a view along G-G in FIG. 22.
Figure 24:
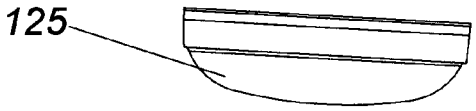
FIG. 24 is a view along C-C in FIG. 21.
Figure 25:
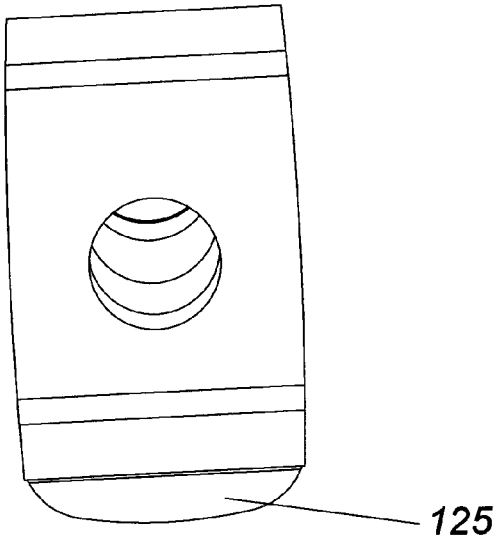
FIG. 25 is a view along F-F in FIG. 21.
Figure 22:
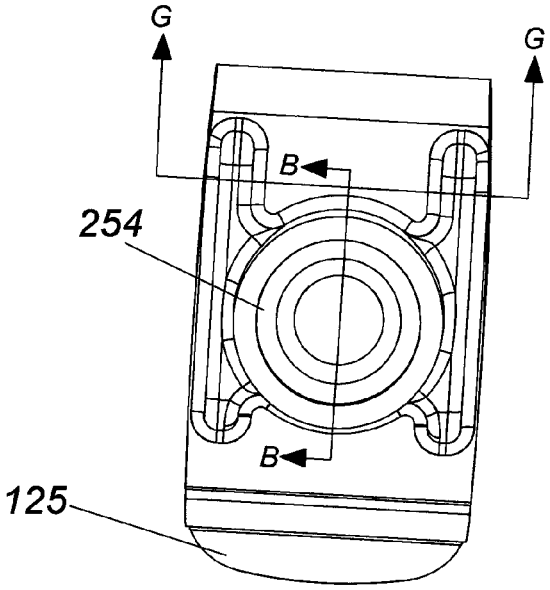
FIG. 22 is a view along A-A in FIG. 21.
Figure 27:
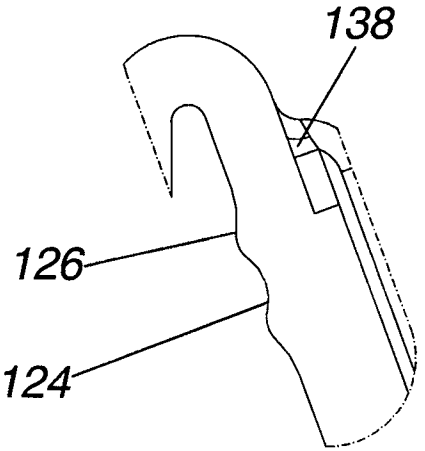
FIG. 27 is a detailed view of section D in FIG. 21.
Figure 26:
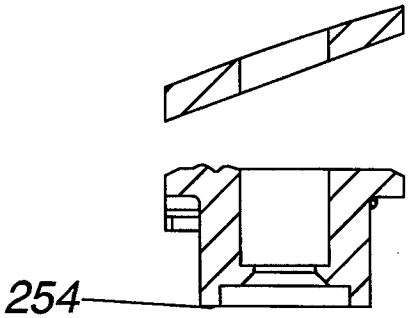
FIG. 26 is a view along B-B in FIG. 22.
Figure 29:
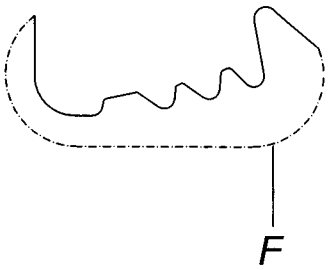
FIG. 29 is a view of section F in FIG. 28.
Figure 28:
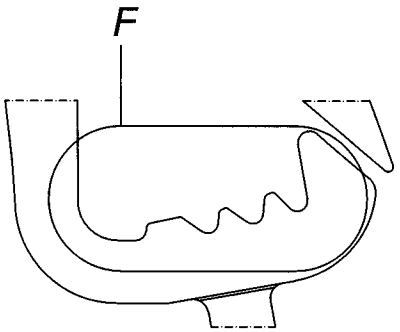
FIG. 28 is a detailed view of section E in FIG. 21.
Figure 30:
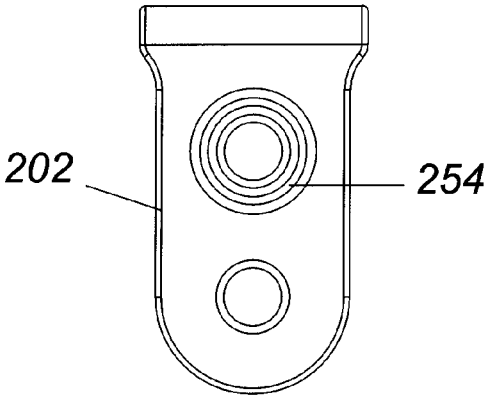
FIG. 30 is a top view of the adaptor bracket of FIG. 14.

Another embodiment of the adaptor bracket is illustrated as 260 in FIGS. 18-20. While it is illustrated as preferably L-shaped, those skilled in the art recognize that it could be formed to be more or less than 90 degrees so long as the offset arm can rotate about 360 degrees. A first leg portion 262 of the adaptor bracket 260 is constructed and arranged to fit into a slot 261 of a hard hat. A catch 293 is provided to engage the hard hat to secure the two pieces together. The catch includes a ramp side 294 and a catch side 295. The slot 261 is preferably on either side of a hard hat and is generally rectangular in shape including an undercut or aperture for releasable engagement with the catch member. The other portion 264 of the adaptor bracket includes a bearing member 266. An offset arm 268, similar to arms 204 and 304, is pivotally secured to the adaptor bracket 260 at bearing 266. The offset arm is preferably S-shaped. In this configuration, the light source 270 is positioned above an individual's eyes and relatively close to their head. The offset arm can pivot through 360 degrees. One end of the offset arm includes a bearing 272. Bearing 272 enables the light source holder 274 to be pivotally secured to the offset arm 268. The light source holder 274 can also pivot through 360 degrees. While the offset arm 268 is preferably S-shaped, it is recognized that other shapes are possible. The offset arm could also be a flexible member which is able to be adjusted in three dimensions.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An illumination system securable to a hard hat comprising:

an adapter bracket constructed and arranged for attachment to a hard hat, said adapter bracket being substantially L-shaped having a first leg sized to fit into a slot integrally formed into the side of a hard hat and a second leg including at least one first portion of a bearing member for releasable rotational cooperation with an offset arm, said first portion of said bearing member being positioned on an outside surface of said second leg;

an offset arm being substantially L-shaped when viewed from an end, said offset arm having a second portion of a bearing member positioned on an outside surface of a first leg for snap together cooperation with said first portion of said bearing member on said adapter bracket, said bearing members providing rotation of said offset arm with respect to said adapter bracket while securing said offset arm to said adapter bracket, a second leg of said offset arm including a first portion of a bearing member on an inner surface thereof for snap together cooperation with a light source holder;

a light source holder being generally C-shaped when viewed from an end, said light source holder having an inner bore sized to frictionally cooperate with a self-contained light source, an outer surface of said light source holder including a second portion of a bearing member for snap together cooperation with said first portion of a bearing member on said second leg of said offset arm, whereby said light source holder is free to rotate about said bearing members and said light source holder is secured to said offset arm.

2. The illumination system of claim 1 wherein said first leg of said adapter bracket includes a catch member, said catch member constructed and arranged to cooperate with a surface within said hard hat slot to releasably secure said adapter bracket to said hard hat.

3. The illumination system of claim 2 wherein said catch member includes a ramp side and a catch side, said ramp side constructed and arranged to deflect a portion of said slot, whereby said deflected portion snaps back to engage said catch side.

4. The illumination system of claim 1 wherein said offset arm includes an S-shape when viewed from the side, said offset arm rotatable to move said light source forward or backward with respect to said adapter bracket.

5. The illumination system of claim 1 wherein said second leg of said adapter bracket includes a second first portion of a bearing assembly for releasable rotational cooperation with an offset arm, said second first portion of said bearing assembly being positioned on an inside surface of said second leg, whereby said offset arm is constructed and arranged to cooperate with either said first portion of a bearing assembly to allow said offset arm to be extended in opposite directions with respect to said adapter bracket.

6. The illumination system of claim 1 wherein said first and said second portions of said bearing assembly are constructed and arranged to break away from each other in the event that a portion of said illumination assembly is inadvertently caught on a foreign object.

7. The illumination system of claim 1 wherein said bearing assembly includes a post and a socket which snap together for connection.

8. The illumination system of claim 7 wherein said socket includes an undercut in said socket to provide for a snap lock assembly.

9. The illumination system of claim 7 wherein said post is split having a pair of spaced apart legs.

10. The illumination system of claim 1 wherein the positions of said first and said second bearing members are reversed.

11. The illumination system of claim 1 wherein said adapter bracket is replaced by an adapter clip, whereby said offset arm and said light source holder are securable to the temple arm portion of a pair of eyeglasses.

12. The illumination system of claim 11 wherein said adapter clip comprises a substantially L-shaped portion having a closure member hingedly secured to the first leg of said closure member, whereby a second end of said closure member cooperates with a second leg of said closure member to close said adapter clip around said temple arm, said closure member including a first portion of a bearing member on an outer surface thereof.

13. The illumination system of claim 12 wherein said second leg of said L-shaped portion includes a plurality of ridges, said ridges constructed and arranged to cooperate with an end portion of said closure member to maintain said adapter clip in a closed position.

14. The illumination system of claim 11 wherein an inner surface of said closure member includes grooves sized and shaped to cooperate with the temple arm portion of a pair of glasses, whereby said temple arm portion of said glasses is retained within one of said grooves.

15. The illumination system of claim 14 wherein said grooves are sized progressively to cooperate with different sized temple arms.

* * * * *